US006231335B1

(12) United States Patent
Huang

(10) Patent No.: US 6,231,335 B1
(45) Date of Patent: May 15, 2001

(54) LIGHTER HAVING A LOCK DEVICE

(76) Inventor: Ying Fang Huang, No. 2, Lane 22, Sec. 2, San Hsi Road, 404, Taichung (TW)

( * ) Notice: Subject to any disclaimer, the term of this patent is extended or adjusted under 35 U.S.C. 154(b) by 0 days.

(21) Appl. No.: 09/606,817

(22) Filed: Jun. 30, 2000

(51) Int. Cl.[7] ..... F23Q 11/36; F23Q 2/16; F23Q 2/50

(52) U.S. Cl. ..... 431/153; 431/255; 431/152

(58) Field of Search ..... 431/153, 152, 431/150, 144, 135, 134, 129, 255

(56) References Cited

U.S. PATENT DOCUMENTS 1,817,335 * 8/1931 Aronson ..... 431/152
2,513,125 * 6/1950 Wiessner ..... 431/152
4,144,018 * 3/1979 Tanaka ..... 431/150
4,487,570 * 12/1984 Lowenthal ..... 431/153
5,401,163 * 3/1995 Yamazaki ..... 431/153
5,531,591 * 7/1996 Yamazaki ..... 431/255
5,713,733 2/1998 Ming ..... 431/344

* cited by examiner

*Primary Examiner*—Carl D. Price
(74) *Attorney, Agent, or Firm*—Charles E. Baxley

(57) ABSTRACT

A lighter includes an igniting button disposed in a gas container, a block slidably received in the container, a cap engaged on top of the container and pivotally secured to the block with a pivot shaft, and a an actuator secured to the block and moved in concert with the block relative to the container to depress the button for igniting purposes. A latch is slidably received in the an actuator and biased to engage with the cap and to prevent the cap from being rotated relative to the block about the pivot shaft and to prevent the an actuator from being depressed by the children inadvertently.

10 Claims, 5 Drawing Sheets

LIGHTER HAVING A LOCK DEVICE

BACKGROUND OF THE INVENTION

1. Field of the Invention

The present invention relates to a lighter, and more particularly to a lighter having a lock device.

2. Description of the Prior Art

Typical lighters, such as the cigarette lighters are widely used and may be easily available everywhere. U.S. Pat. No. 5,713,733 to Ming discloses one of the typical cigarette lighters. The typical cigarette lighters have no lock devices or have no safety mechanisms for preventing the typical cigarette lighters from being easily operated by the children inadvertently.

The present invention has arisen to mitigate and/or obviate the afore-described disadvantages of the conventional lighters.

SUMMARY OF THE INVENTION

The primary objective of the present invention is to provide a lighter having a lock device for locking the lighter and for preventing the lighter from being operated by children inadvertently.

In accordance with one aspect of the invention, there is provided a lighter comprising a container including a chamber formed therein for receiving gas therein, the container including an upper portion, an igniting device secured in the container and including a button to be depressed relative to the container for igniting purposes, a block slidably received in the container, a cap engaged on the upper portion of the container and pivotally secured to the block with a pivot shaft, an actuator secured to the slide and moved in concert with the block relative to the container and engaged with the button for depressing the button to ignite the lighter, and a latching means for latching the actuator to the cap and to prevent the cap from being rotated relative to the block about the pivot shaft and to prevent the actuator from being depressed inward of the container inadvertently by the children.

The block is slidable inward and outward of the container, the cap includes at least one leg extended therefrom and extended inward of the container and pivotally secured to the container with the pivot shaft. A device may further be provided for guiding the block to move inward and outward relative to the container.

The actuator includes a stop extended inward thereof for engaging with the button and for depressing the button when the actuator is depressed inward of the container. The actuator includes at least one pin extended therefrom and engaged into the block for securing the actuator to the slide.

The latching means includes a latch slidably received in the actuator and movable toward to the cap to engage with the cap, and includes a biasing means for biasing the latch toward the cap to engage with the cap and to prevent the cap from being rotated relative to the block about the pivot shaft.

The latch includes at least one groove formed therein, the actuator includes a channel formed therein for slidably receiving the latch, and includes at least one rail extended inward of the channel of the actuator and extended and slidably engaged in the groove of the latch to guide the latch to move toward and away from the cap.

The cap includes an extension extended therefrom and includes a head provided on said extension for engaging with the latch. The latch may include an ear extended therefrom for engaging with the extension of the cap and for preventing the cap from being rotated relative to the block about the pivot shaft.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
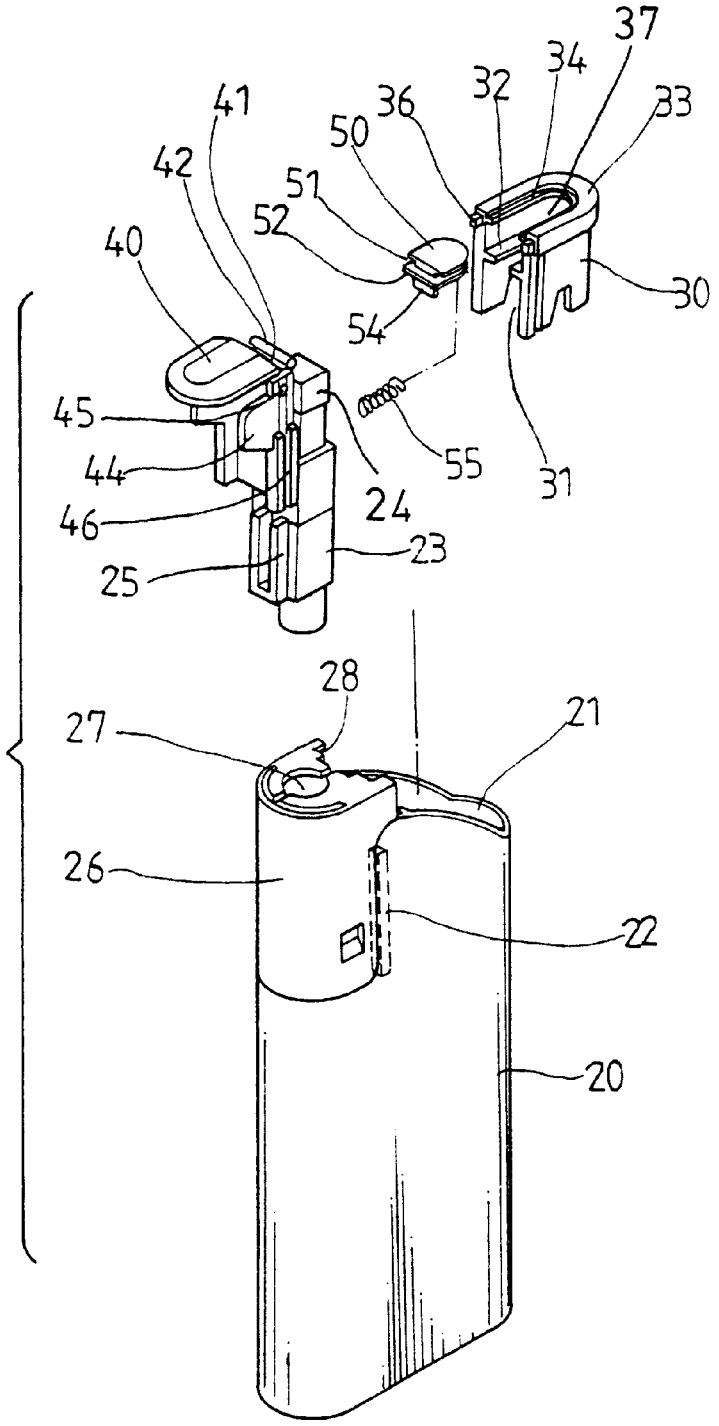
FIG. 1 is an exploded view of a lighter in accordance with the present invention.
Figure 2:
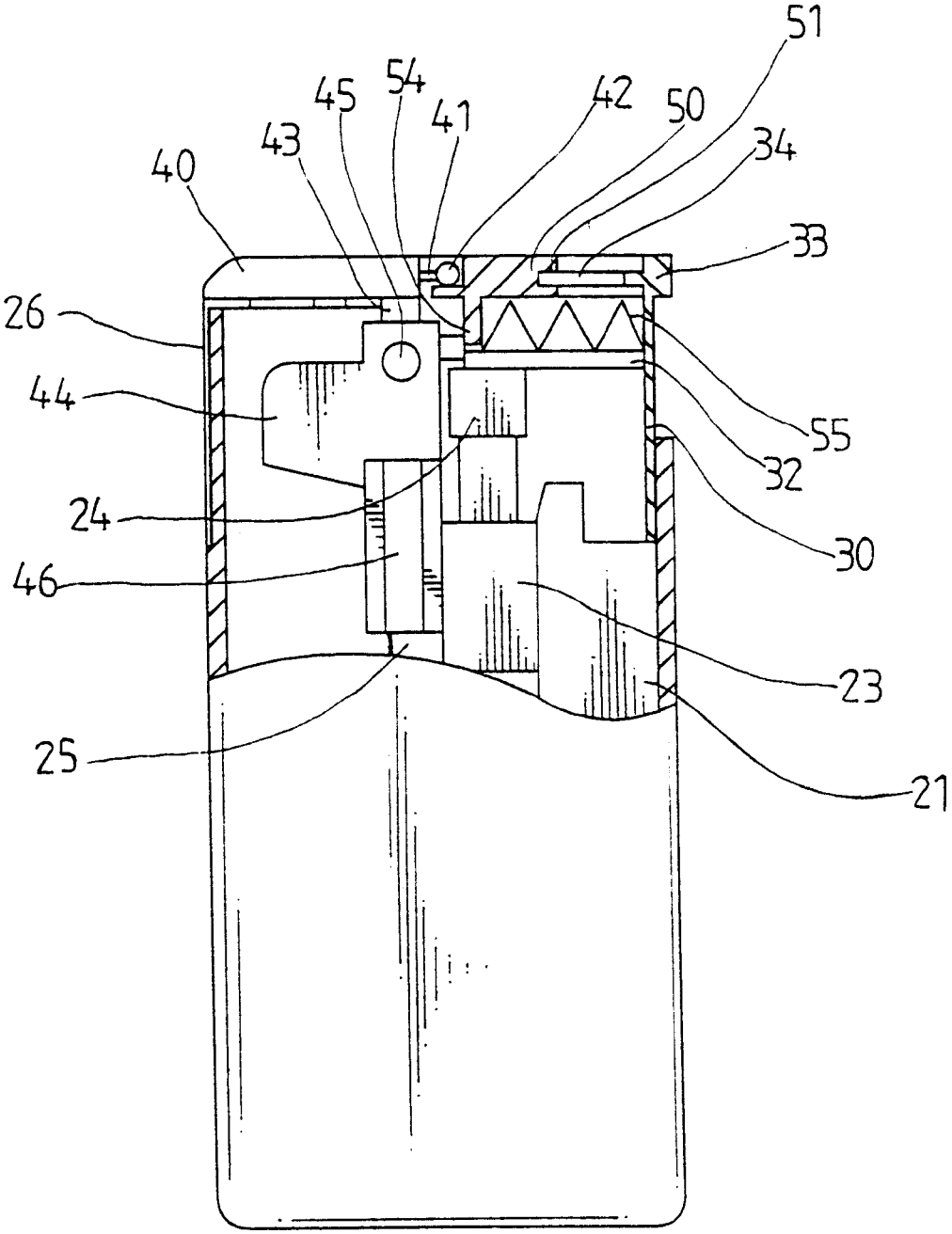
FIG. 2 is a plane schematic view of the lighter, in which a portion of the lighter has been cut off for showing the inner structure of the lighter.
Figure 3:
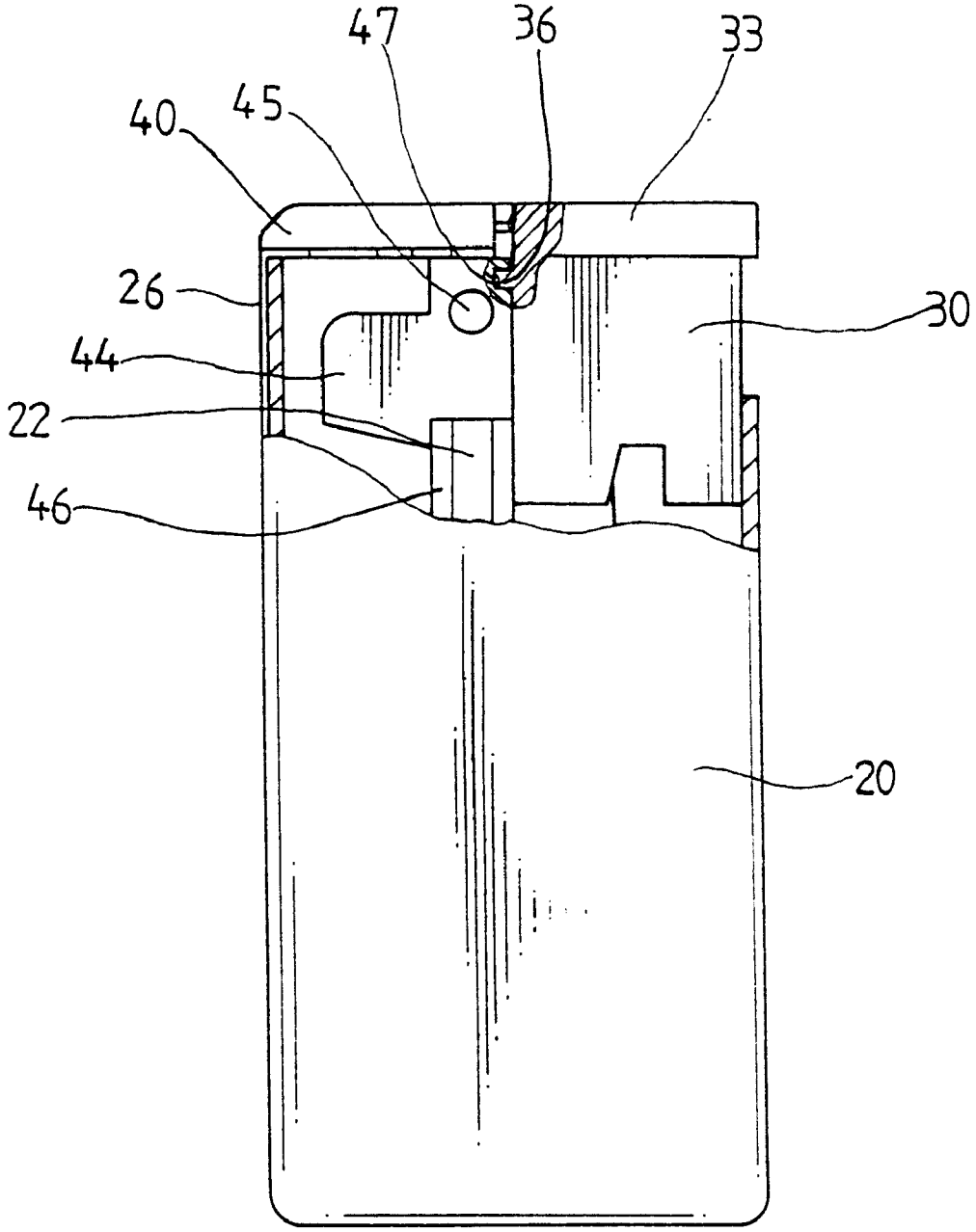
FIG. 3 is a plane schematic view of the lighter, similar to FIG. 2, in which the other portion of the lighter has been cut off for showing the inner structure of the other portion of the lighter.

Referring to the drawings, and initially to FIGS. 1–3, a lighter in accordance with the present invention comprises a container 20 for receiving the gas, particularly the liquidized gas therein. The container 20 includes a chamber 21 formed therein for slidably receiving an actuator 30. An igniting device includes a seat 23 secured in the container 20, and includes a typical button 24 slidably received therein. The seat 23 is solidly secured to the container 20 and may not be moved relative to the container 20. The button 24 may be depressed and moved relative to the seat 23 for igniting purposes. A cover 26 is secured on one side of the top of the container 20 and includes a typical flame orifice 27 formed therein. The above-described lighter mechanism and the operation of the button 24 are typical and will not be described in further details.

The container 20 includes one or more ribs 22 vertically formed or extended therein and extended inward of the chamber 21 thereof. The cover 26 includes a notch 28 formed in the upper portion thereof. A block 44 is slidably received in the container 20 and includes one or more slots 46 formed therein for slidably receiving the ribs 22 respectively and for guiding the block 44 to move up and down or inward and outward relative to the container 20. The seat 23 may further include one or more depressions 25 formed therein for slidably receiving and guiding the block 44 to move relative to the seat 23 and the container 20. A cap 40 is disposed on top of the cover 26 for blocking the flame orifice 27 of the cover 26 and includes one or more legs 43 extended inward of the container 20 or the cover 26 and preferably extended inward of the container 20 or the cover 26 via the notch 28 of the cover 28. The legs 43 are pivotally secured to the block 44 at a pivot shaft 45, for allowing the cap 40 to be rotated relative to the block 44 about the pivot shaft 45.

The actuator 30 includes a space 31 formed therein for receiving the upper portion or the head of the button 24 and includes a stop 32 extended inward of the space 31 thereof for engaging with or for engaging on top of the button 24, such that the button 24 may be depressed downward relative to the seat 23 by the actuator 30 when the actuator 30 is depressed inward of the chamber 21 of the container 20. The actuator 30 includes a peripheral protrusion 33 provided on top thereof and extended laterally outward therefrom for engaging with the container 20 and for limiting the relative movement between the actuator 30 and the container 20 and for preventing the actuator 30 from being completely depressed and engaged into the container 20. The actuator 30 includes a channel 37 formed in the upper portion thereof and includes one or more guide rails 34 extended inward of the channel 37 of the actuator 30. The actuator 30 includes one or more pins 36 extended therefrom and engaged into the block 44, such as engaged into the cavity 47 (FIG. 3) that is formed in the block 44, for securing the actuator 30 to the block 44 and for allowing the actuator 30 and the block 44 to be moved up and down in concert with each other; i.e., the block 44 may be moved up and down by the actuator 30.

A latch 50 includes one or more grooves 51 formed therein for slidably receiving the guide rails 34 of the actuator 30 and for guiding the latch 50 to move along the channel 37 of the actuator 30 and for allowing the latch 50 to be moved toward and away from the block 44. The latch 50 includes an ear 52 laterally extended outward therefrom and extended toward the block 44, and includes a flap 54 extended downward therefrom. A spring 55 is engaged between the flap 54 and the actuator 30 for biasing the latch 50 toward the block 44.

Figure 4:
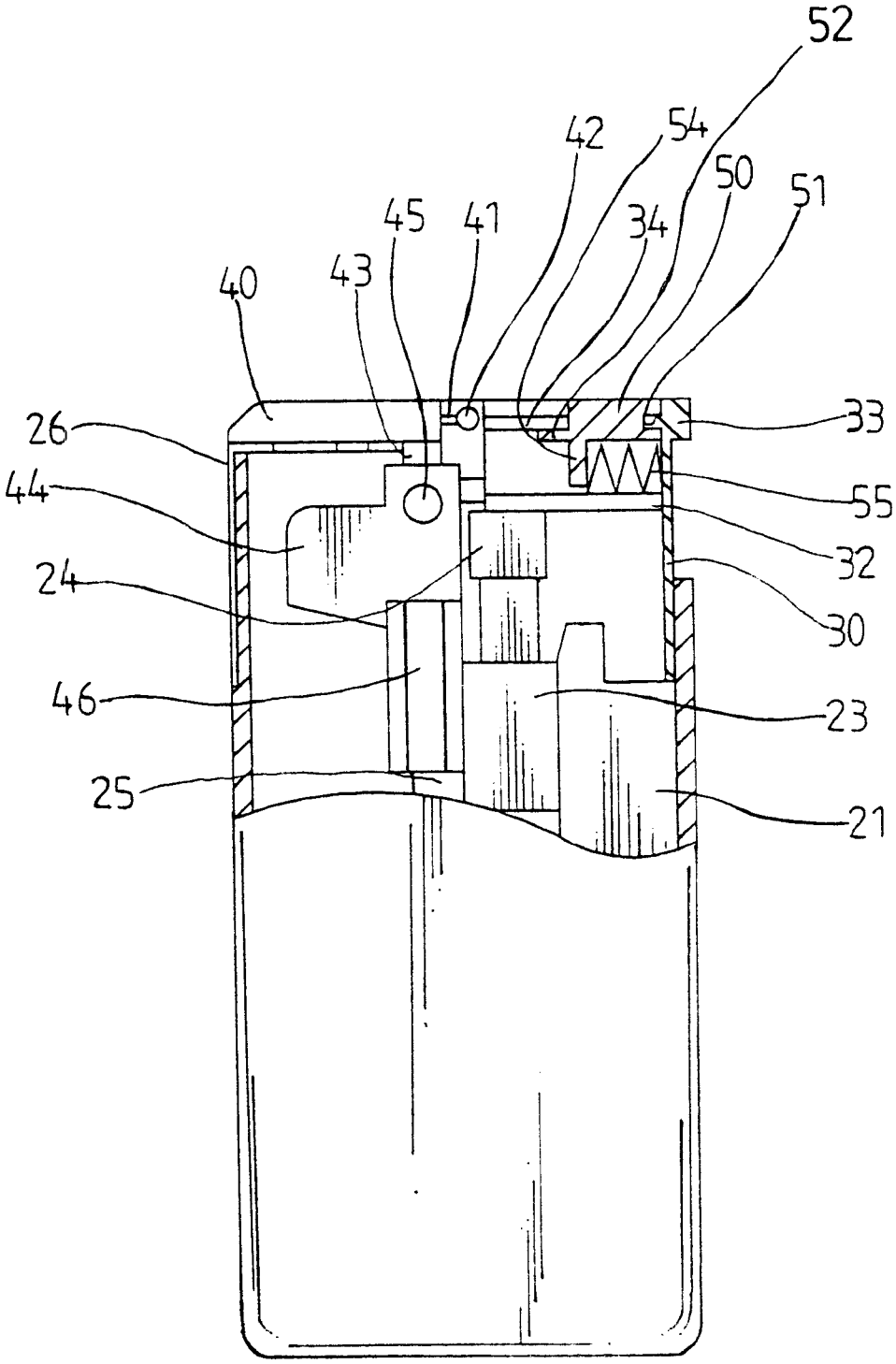
FIGS. 4 and 5 are plane schematic views of the lighter, similar to FIG. 2, illustrating the operation of the lighter.
Figure 5:
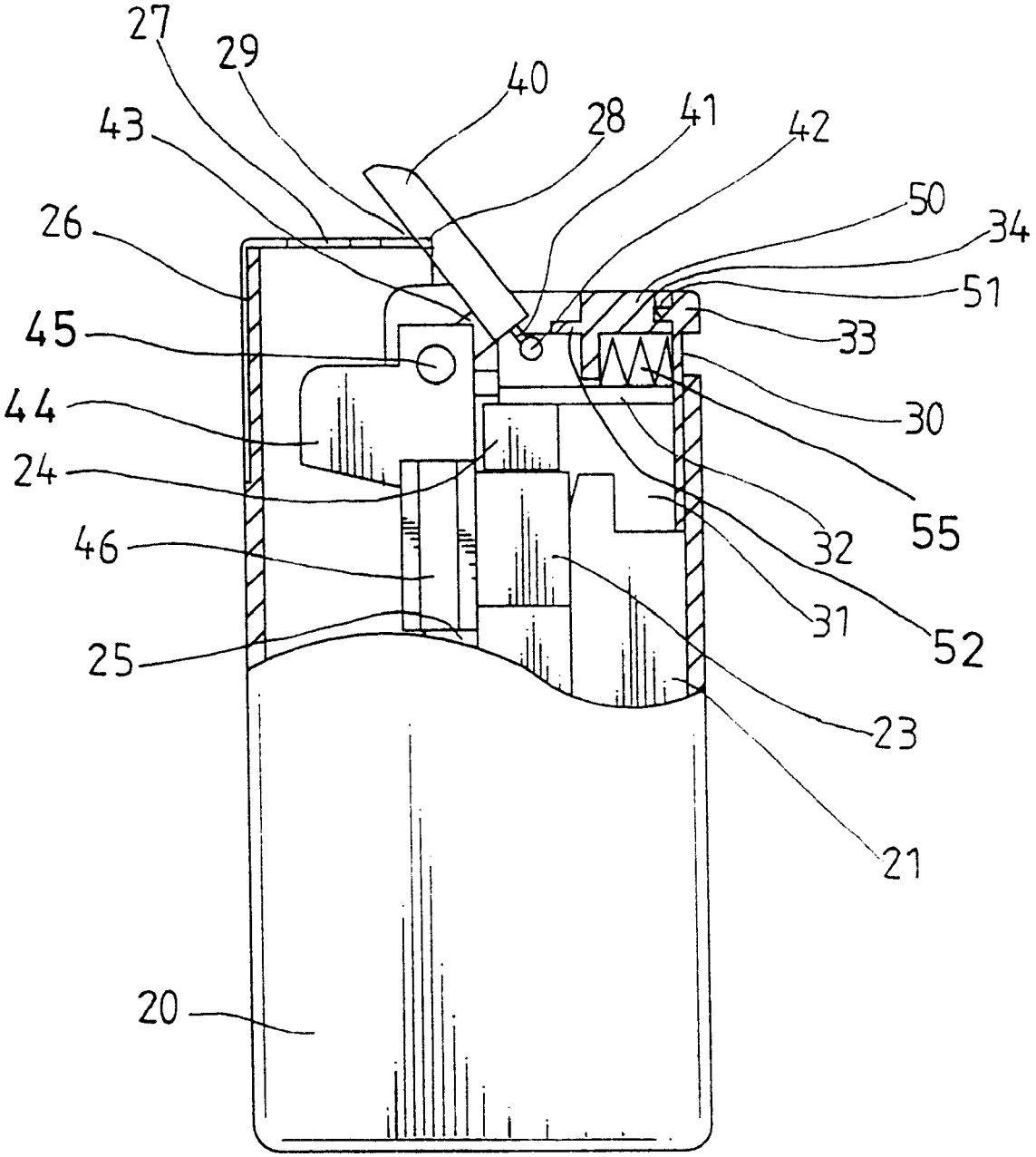

As best shown in FIGS. 2, 4 and 5, the cap 40 includes an extension 41 extended laterally outward therefrom and extended toward the latch 50 for engaging with the ear 52 of the latch 50, and includes a head 42 provided and secured on the free end thereof for engaging with the ear 52 of the latch 50 which may prevent the cap 40 from being rotated relative to the block 44 about the pivot shaft 45.

In operation, as shown in FIG. 2, the actuator 30 and the block 44 are secured together. The extension 41 and/or the head 42 of the cap 40 is engaged on the ear 52 of the latch 50 such that the cap 40 may be locked and may be prevented from being rotated relative to the block 44 about the pivot shaft 45. When the cap 40 may not be rotated about the pivot shaft 45, the cap 40 and thus the block 44 and the actuator 30 are locked and may not be moved downward or inward of the container 20, such that the button 24 of the igniting device may not be depressed by the actuator 30, and such that the lighter may be prevented from being depressed and operated by children inadvertently.

As shown in FIGS. 4 and 5, when the latch 50 is depressed or moved relative to the actuator 30 and away from the cap 40 against the spring 55, the latch 50, particularly the ear 52 of the latch 50 may be moved away and disengaged from the extension 41 and/or the head 42 of the cap 40. At this moment, the cap 40 is allowed to be rotated relative to the block 44 about the pivot shaft 45 and is allowed to be disengaged or avoided from the cover 26 such that the block 44 and the actuator 30 may be depressed downward or inward of the container 20 to actuate or to depress the button 24 of the igniting device for igniting purposes.

It is to be noted that the cap 40 may be locked and may prevent the block 44 and the actuator 30 from being depressed relative to the igniting device when the latch 50 is biased toward the cap 40, such that the actuator 30 may be locked and the lighter may be prevented from being depressed and actuated or operated by children inadvertently. The cap 40 may be rotated relative to the block 44 and/or the cover 26 about the pivot shaft 45 only when latch 50 is moved away from the cap 40.

Accordingly, the lighter in accordance with the present invention includes a lock device for locking the lighter and for preventing the lighter from being operated by children inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lighter comprising:

a container including a chamber formed therein for receiving gas therein, said container including an upper portion, an igniting device secured in said container and including a button to be depressed relative to said container for igniting purposes, a block slidably received in said container, a cap engaged on said upper portion of said container and pivotally secured to said block with a pivot shaft, an actuator secured to said block and moved in concert with said block relative to said container, said actuator being engaged with said button of said igniting device for depressing said button when said actuator is depressed inward of said container, latching means for latching said actuator to said cap and to prevent said cap from being rotated relative to said block about said pivot shaft and to prevent said actuator from being depressed inward of said container, and means for guiding said block to move inward and outward relative to said container.

2. The lighter according to claim 1, wherein said block is slidable inward and outward of said container, said cap includes at least one leg extended therefrom and extended inward of said container and pivotally secured to said container with said pivot shaft.

3. The lighter according to claim 1, wherein said actuator includes a stop extended inward thereof for engaging with said button and for depressing said button when said actuator is depressed inward of said container.

4. The lighter according to claim 1, wherein said actuator includes at least one pin extended therefrom and engaged into said block for securing said actuator to said block.

5. The lighter according to claim 1, wherein said latching means includes a latch slidably received in said actuator and movable toward to said cap to engage with said cap and to prevent said cap from being rotated relative to said block about said pivot shaft.

6. The lighter according to claim 5, wherein said latching means further includes a biasing means for biasing said latch toward said cap to engage with said cap and to prevent said cap from being rotated relative to said block about said pivot shaft.

7. The lighter according to claim 5, wherein said cap includes an extension extended therefrom and engaged with said latch for preventing said cap from being rotated relative to said block about said pivot shaft.

8. The lighter according to claim 7, wherein said extension of said cap includes a head provided thereon for engaging with said latch and for preventing said cap from being rotated relative to said block about said pivot shaft.

9. The lighter according to claim 8, wherein said latch includes an ear extended therefrom for engaging with said extension of said cap and for preventing said cap from being rotated relative to said block about said pivot shaft.

10. A lighter comprising:

a container including a chamber formed therein for receiving gas therein, said container including an upper portion, an igniting device secured in said container and including a button to be depressed relative to said container for igniting purposes, a block slidably received in said container, a cap engaged on said upper portion of said container and pivotally secured to said block with a pivot shaft, an actuator secured to said block and moved in concert with said block relative to said container, said actuator being engaged with said button of said igniting device for depressing said button when said actuator is depressed inward of said container, and latching means for latching said actuator to said cap and to prevent said cap from being pivoted relative to said block about said pivot shaft and to prevent said actuator from being depressed inward of said container, said latching means including a latch slidably received in said actuator and movable toward to said cap to engage with said cap and to prevent said cap from being rotated relative to said block about said pivot shaft, wherein said latch includes at least one groove formed therein, said actuator includes a channel formed therein for slidably receiving said latch, and includes at least one rail extended inward of said channel of said actuator and extended and slidably engaged in said at least one groove of said latch to guide said latch to move toward and away from said cap.

* * * * *